US012453883B2

(12) United States Patent
Peal et al.

(10) Patent No.: US 12,453,883 B2
(45) **Date of Patent: *Oct. 28, 2025**

(54) ASSISTED UNRACKING OF DIGITAL RESISTANCE

(71) Applicant: Tonal Systems, Inc., San Francisco, CA (US)

(72) Inventors: Gabriel Peal, San Francisco, CA (US); Brandt Belson, San Francisco, CA (US)

(73) Assignee: Tonal Systems, Inc., San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/242,378

(22) Filed: Sep. 5, 2023

(65) Prior Publication Data

US 2024/0100386 A1 Mar. 28, 2024

Related U.S. Application Data

(63) Continuation of application No. 17/855,065, filed on Jun. 30, 2022, now Pat. No. 11,779,793.

(60) Provisional application No. 63/316,073, filed on Mar. 3, 2022.

(51) Int. Cl.
*A63B 21/00* (2006.01)

(52) U.S. Cl.
CPC ..... *A63B 21/151* (2013.01); *A63B 21/00069* (2013.01); *A63B 2220/13* (2013.01)

(58) Field of Classification Search
CPC . A63B 24/0087; A63B 21/002; A63B 23/047; A63B 24/0062; A63B 2024/0065; A63B 2024/0093; A63B 21/0059; A63B 2220/10; A63B 2220/51; A63B 2220/54; A63B 2220/58; A63B 2220/80; A63B 2220/803; A63B 2220/805; A63B 2220/833

See application file for complete search history.

(56) References Cited

U.S. PATENT DOCUMENTS

| | | | | |
|---|---|---|---|---|
| 4,869,497 | A | 9/1989 | Stewart | |
| 5,271,416 | A * | 12/1993 | Lepley | A61B 5/1036 600/595 |
| 5,435,798 | A | 7/1995 | Habing | |
| 5,697,869 | A | 12/1997 | Ehrenfried | |
| 6,280,361 | B1 | 8/2001 | Harvey | |
| 9,272,186 | B2 | 3/2016 | Reich | |
| 10,188,890 | B2 * | 1/2019 | Olson | A63B 21/153 |
| 10,220,235 | B2 * | 3/2019 | Norris | A63B 21/153 |
| 10,265,572 | B2 * | 4/2019 | Bach | A63B 24/0087 |
| 10,335,626 | B2 * | 7/2019 | Orady | A63B 21/169 |
| 10,589,163 | B2 | 3/2020 | Orady | |
| 10,661,112 | B2 | 5/2020 | Orady | |
| 10,874,905 | B2 | 12/2020 | Belson | |

(Continued)

*Primary Examiner* — Andrew M Kobylarz
(74) *Attorney, Agent, or Firm* — Van Pelt, Yi & James LLP

(57) ABSTRACT

Assisted unracking of digital resistance includes detecting a state of a cable. A motor is mechanically coupled to the cable to provide resistance during an exercise by tensioning the cable. It further includes determining a readiness of the user to accept resistance based at least in part on the detected state of the cable. It further includes selectively applying resistance by the motor to the cable according to the determined readiness of the user to accept the resistance.

18 Claims, 4 Drawing Sheets

(56) References Cited

U.S. PATENT DOCUMENTS

| | | | | |
|---|---|---|---|---|
| 11,779,793 | B2 * | 10/2023 | Peal | A63B 21/00069 482/92 |
| 2007/0232450 | A1 | 10/2007 | Hanoun | |
| 2008/0248926 | A1 | 10/2008 | Cole | |
| 2010/0227744 | A1 | 9/2010 | Dang | |
| 2011/0098155 | A1 | 4/2011 | Lemos | |
| 2011/0165995 | A1 | 7/2011 | Paulus | |
| 2011/0165996 | A1 | 7/2011 | Paulus | |
| 2011/0172058 | A1 | 7/2011 | Deaconu | |
| 2014/0038777 | A1 | 2/2014 | Bird | |
| 2018/0021616 | A1 | 1/2018 | Orady | |
| 2018/0214729 | A1 | 8/2018 | Rubin | |
| 2019/0046830 | A1 * | 2/2019 | Chiavegato | A63B 24/0062 |
| 2020/0054914 | A1 | 2/2020 | Lafrance | |
| 2020/0261771 | A1 * | 8/2020 | Belson | A63B 21/002 |
| 2021/0394023 | A1 | 12/2021 | Belson | |
| 2021/0402259 | A1 | 12/2021 | Belson | |

* cited by examiner

ASSISTED UNRACKING OF DIGITAL RESISTANCE

CROSS REFERENCE TO OTHER APPLICATIONS

This application is a continuation of U.S. patent application Ser. No. 17/855,065, entitled ASSISTED UNRACKING OF DIGITAL RESISTANCE filed Jun. 30, 2022 which is incorporated herein by reference for all purposes, which claims priority to U.S. Provisional Application No. 63/316,073, entitled WEIGHT ON-OFF filed Mar. 3, 2022 which is incorporated herein by reference for all purposes.

BACKGROUND OF THE INVENTION

Strength training at home is convenient but often done alone, without the assistance of trained staff. Strength training includes performing movements with high weight that may endanger a user, be awkward for a user, or be difficult for a user to start or end alone.

BRIEF DESCRIPTION OF THE DRAWINGS

Various embodiments of the invention are disclosed in the following detailed description and the accompanying drawings.

DETAILED DESCRIPTION

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

Example Digital Strength Trainer

Figure 1A:
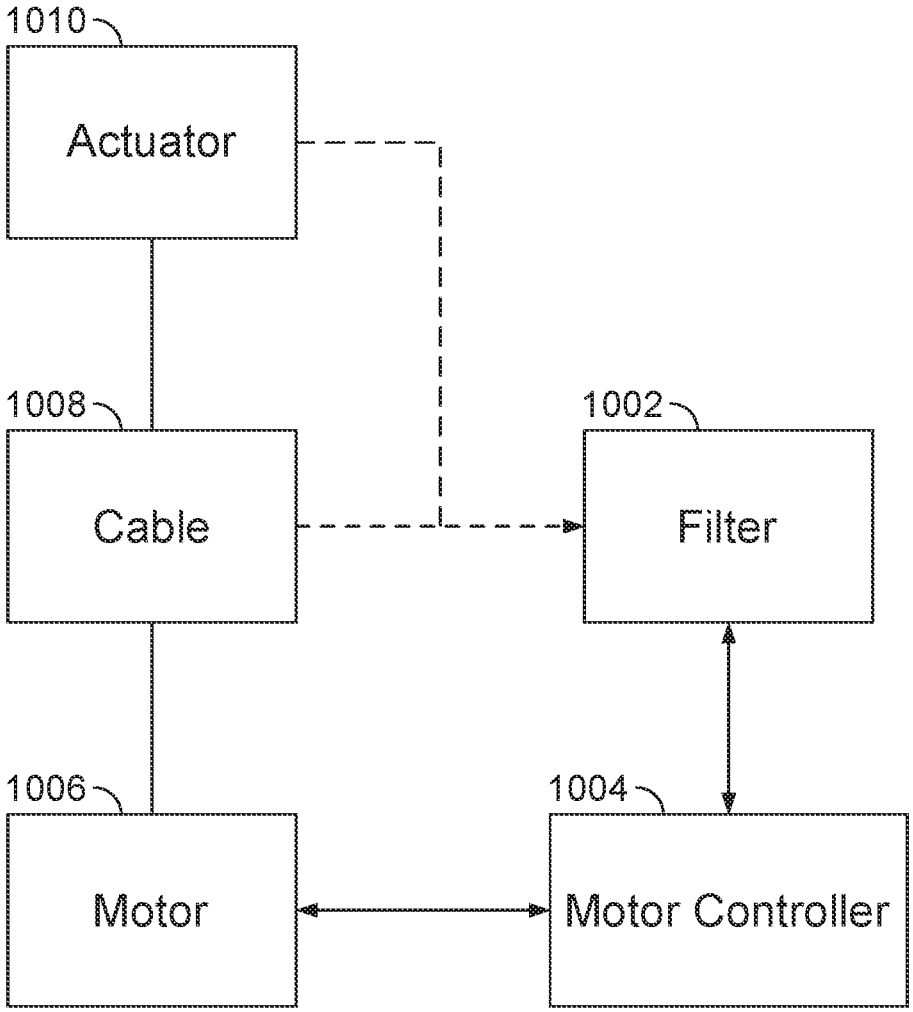
FIG. 1A illustrates an embodiment of an exercise machine.

FIG. 1A illustrates an embodiment of an exercise machine. In particular, the exercise machine of FIG. 1A is an example of a digital strength training machine. In some embodiments, a digital strength trainer uses electricity to generate tension/resistance. Examples of electronic resistance include using an electromagnetic field to generate tension/resistance, using an electronic motor to generate tension/resistance, and using a three-phase brushless direct-current (BLDC) motor to generate tension/resistance. In various embodiments, the assisted weight loading techniques described herein may be variously adapted to accommodate other types of exercise machines using different types of load elements without limitation, such as exercise machines based on pneumatic cylinders, springs, weights, flexing nylon rods, elastics, pneumatics, hydraulics, and/or friction.

Such a digital strength trainer using electricity to generate tension/resistance is also versatile by way of using dynamic resistance, such that tension/resistance may be changed nearly instantaneously. When tension is coupled to position of a user against their range of motion, the digital strength trainer may apply arbitrary applied tension curves, both in terms of position and in terms of phase of the movement: concentric, eccentric, and/or isometric. Furthermore, the shape of these curves may be changed continuously and/or in response to events; the tension may be controlled continuously as a function of a number of internal and external variables including position and phase, and the resulting applied tension curve may be pre-determined and/or adjusted continuously in real time.

The example exercise machine of FIG. 1A includes the following:

- a motor controller circuit (1004), which in some embodiments includes a processor, inverter, pulse-width-modulator, and/or a Variable Frequency Drive (VFD);
- a motor (1006), for example, a three-phase brushless DC driven by the controller circuit (1004). While a single motor is shown in this example, other numbers of motors may be used. For example, dual motors may be used;
- a spool/hub with a cable (1008) wrapped around the spool and coupled to the spool. On the other end of the cable an actuator (1010) is coupled in order for a user to grip and pull on. Examples of actuators include handles and bars that are attached to the cables. The actuators may be attached to the cables at distal ends of the arms of the exercise machine, which are described in further detail below. The spool is coupled to the motor (1006) either directly or via a shaft/belt/chain/gear mechanism;
- a filter (1002), to digitally control the controller circuit (1004) based on receiving information from the cable (1008) and/or actuator (1010);
- optionally (not shown in FIG. 1A) a gearbox between the motor and spool. Gearboxes multiply torque and/or friction, divide speed, and/or split power to multiple spools. A number of combinations of motor and gearbox may also be used. A cable-pulley system may be used in place of a gearbox, and/or a dual motor may be used in place of a gearbox;

one or more of the following sensors (not shown in FIG. 1A):

encoders: In various embodiments, encoders are used to measure cable lengths (e.g., left and right cable lengths in this example), cable speeds, weight (tension), etc.

One example of an encoder is a position encoder; a sensor to measure position of the actuator (1010) or motor (1006). Examples of position encoders include a hall effect shaft encoder, grey-code encoder on the motor/spool/cable (1008), an accelerometer in the actuator/handle (1010), optical sensors, position measurement sensors/methods built directly into the motor (1006), and/or optical encoders. In one embodiment, an optical encoder is used with an encoding pattern that uses phase to determine direction associated with the low resolution encoder. As another example, a magnetic encoder is used to determine cable position/length. Other mechanisms that measure back-EMF (back electromagnetic force) from the motor (1006) in order to calculate position may also be used;

a motor power sensor; a sensor to measure voltage and/or current being consumed by the motor (1006);

a user tension sensor; a torque/tension/strain sensor and/or gauge to measure how much tension/force is being applied to the actuator (1010) by the user. In one embodiment, a tension sensor is built into the cable (1008). Alternatively, a strain gauge is built into the motor mount holding the motor (1006). As the user pulls on the actuator (1010), this translates into strain on the motor mount which is measured using a strain gauge in a Wheatstone bridge configuration. In another embodiment, the cable (1008) is guided through a pulley coupled to a load cell. In another embodiment, a belt coupling the motor (1006) and cable spool or gearbox (1008) is guided through a pulley coupled to a load cell. In another embodiment, the resistance generated by the motor (1006) is characterized based on the voltage, current, or frequency input to the motor.

Another example of sensors includes inertial measurement units (IMUs). In some embodiments, IMUs are used to measure the acceleration and rate of rotation of actuators. The IMUs may be embedded within or attached to actuators (e.g., in both handles or as an attachment on a bar).

In some embodiments, an IMU is placed on the cable (e.g., via a clip) to determine inertial measurements with respect to the cable. As another example, IMUs may be included in a device that clips onto an actuator accessory such as a bar handle.

Another example type of sensor used by the exercise machine includes cameras.

In some embodiments, the exercise machine includes an embedded camera.

In some embodiments, the exercise machine is communicatively coupled (either in a wired or wireless manner) with a dedicated accessory camera external to the exercise machine that is paired with the exercise machine. The dedicated accessory camera may be set up in a different location to the exercise machine, such as on an adjacent wall, above the exercise machine on the same wall, on a tripod, etc.

In some embodiments, the exercise machine is paired with an external device that has or is attached to a camera, where such devices include mobile phones, tablets, computers, etc.

Various types of cameras may be used. As one example, RGB cameras are used. As another example, cameras with depth-sensing capability are used.

In some embodiments, infrared cameras are used that measure heat, where in some embodiments such information is used to deduce quantities such as muscle exertion, soreness, etc.

In some embodiments, the sensors used by the exercise machine include accessories such as smart watches, with which the exercise machine may be communicatively coupled (e.g., via a wireless connection such as Bluetooth or WiFi). The readings from such sensors may then be used to, for example, monitor form, determine user exertion, etc.

Other examples of accessories that may be communicatively coupled with the exercise machine include: smart clothing that measures muscle engagement or movement; and smart mats or smart benches that measure spatial distribution of force when the user is on them.

In some embodiments, the exercise machine includes mechanisms to locate devices (e.g., actuators, IMUs, etc.) in 3-Dimensional space. As one example, Bluetooth Low Energy (BLE) spatial locationing (e.g., Angle of Arrival and Angle of Departure "AoA/AoD") is used to locate devices in 3-D space.

In one embodiment, a three-phase brushless DC motor (1006) is used with the following:

a controller circuit (1004) combined with the filter (1002) that includes:

a processor that runs software instructions;

three pulse width modulators (PWMs), each with two channels, modulated at 20 kHz;

six transistors in an H-Bridge configuration coupled to the three PWMs;

optionally, two or three ADCs (Analog to Digital Converters) monitoring current on the H-Bridge; and/or optionally, two or three ADCs monitoring back-EMF voltage;

the three-phase brushless DC motor (1006), which in some embodiments includes a synchronous-type and/or asynchronous-type permanent magnet motor, such that:

the motor (1006) may be in an "out-runner configuration" as described below;

the motor (1006) may have a maximum torque output of at least 60 Nm and a maximum speed of at least 300 RPMs;

optionally, with an encoder or other method to measure motor position;

a cable (1008) wrapped around the body of the motor (1006) such that the entire motor (1006) rotates, so the body of the motor is being used as a cable spool in one embodiment. Thus, the motor (1006) is directly coupled to a cable (1008) spool. In one embodiment, the motor (1006) is coupled to a cable spool via a shaft, gearbox, belt, and/or chain, allowing the diameter of the motor (1006) and the diameter of the spool to be independent, as well as introducing a stage to add a set-up or step-down ratio if desired. Alternatively, the motor (1006) is coupled to two spools with an apparatus in between to split or share the power between those two spools. Such an apparatus could include a differential gearbox, or a pulley configuration; In some embodiments, the two motors (dual motor configuration) are each coupled with a respective spool.

an actuator (1010) such as a handle, a bar, a strap, or other accessory connected directly, indirectly, or via a connector such as a carabiner to the cable (1008).

In some embodiments, the controller circuit (1002, 1004) is programmed to drive the motor in a direction such that it draws the cable (1008) towards the motor (1006). The user pulls on the actuator (1010) coupled to the cable (1008) against the direction of pull of the motor (1006).

One example purpose of this setup is to provide an experience to a user similar to using a traditional cable-based strength training machine, where the cable is attached to a weight stack being acted on by gravity. Rather than the user resisting the pull of gravity, they are instead resisting the pull of the motor (1006).

Note that with a traditional cable-based strength training machine, a weight stack may be moving in two directions: away from the ground or towards the ground. When a user pulls with sufficient tension, the weight stack rises, and as that user reduces tension, gravity overpowers the user and the weight stack returns to the ground.

By contrast in a digital strength trainer, there is no actual weight stack. The notion of the weight stack is one modeled by the system. The physical embodiment is an actuator (1010) coupled to a cable (1008) coupled to a motor (1006). A "weight moving" is instead translated into a motor rotating. As the circumference of the spool is known and how fast it is rotating is known, the linear motion of the cable may be calculated to provide an equivalency to the linear motion of a weight stack. Each rotation of the spool equals a linear motion of one circumference or $2\pi r$ for radius r. Likewise, torque of the motor (1006) may be converted into linear force by multiplying it by radius r.

If the virtual/perceived "weight stack" is moving away from the ground, motor (1006) rotates in one direction. If the "weight stack" is moving towards the ground, motor (1006) rotates in the opposite direction. Note that the motor (1006) is pulling towards the cable (1008) onto the spool. If the cable (1008) is unspooling, it is because a user has overpowered the motor (1006). Thus, note a distinction between the direction the motor (1006) is pulling, and the direction the motor (1006) is actually turning.

If the controller circuit (1002, 1004) is set to drive the motor (1006) with, for example, a constant torque in the direction that spools the cable, corresponding to the same direction as a weight stack being pulled towards the ground, then this translates to a specific force/tension on the cable (1008) and actuator (1010). Referring to this force as "Target Tension," in one embodiment, this force is calculated as a function of torque multiplied by the radius of the spool that the cable (1008) is wrapped around, accounting for any additional stages such as gear boxes or belts that may affect the relationship between cable tension and torque. If a user pulls on the actuator (1010) with more force than the Target Tension, then that user overcomes the motor (1006) and the cable (1008) unspools moving towards that user, being the virtual equivalent of the weight stack rising. However, if that user applies less tension than the Target Tension, then the motor (1006) overcomes the user and the cable (1008) spools onto and moves towards the motor (1006), being the virtual equivalent of the weight stack returning.

BLDC Motor.

While many motors exist that run in thousands of revolutions per second, an application such as fitness equipment designed for strength training has different requirements and is by comparison a low speed, high torque type application suitable for certain kinds of BLDC motors configured for lower speed and higher torque.

In one embodiment, a specification of such a motor (1006) is that a cable (1008) wrapped around a spool of a given diameter, directly coupled to a motor (1006), behaves like a 200 lbs weight stack, with the user pulling the cable at a maximum linear speed of 62 inches per second. The aforementioned weight and linear speed specifications are but examples for illustrative purposes, and the system may be configured to behave to different specifications. A number of motor parameters may be calculated based on the diameter of the spool.

| User Requirements | |
|---|---|
| Target Weight | 200 lbs |
| Target Speed | 62 inches/sec = 1.5748 meters/sec |

| Requirements by Spool Size | | | | | | |
|---|---|---|---|---|---|---|
| Diameter (inches) | 3 | 5 | 6 | 7 | 8 | 9 |
| RPM | 394.7159 | 236.82954 | 197.35795 | 169.1639572 | 148.0184625 | 131.5719667 |
| Torque (Nm) | 67.79 | 112.9833333 | 135.58 | 158.1766667 | 180.7733333 | 203.37 |
| Circumference (inches) | 9.4245 | 15.7075 | 18.849 | 21.9905 | 25.132 | 28.2735 |

Thus, a motor with 67.79 Nm of force and a top speed of 395 RPM, coupled to a spool with a three inch diameter meets these requirements.

Hub motors are three-phase permanent magnet BLDC direct drive motors in an "out-runner" configuration: throughout this specification, the "out-runner" configuration refers to the permanent magnets being placed outside the stator rather than inside, as opposed to many motors which have a permanent magnet rotor placed on the inside of the stator as they are designed more for speed than for torque. Out-runners have the magnets on the outside, allowing for a larger magnet and pole count and are designed for torque over speed. Another way to describe an out-runner configuration is when the shaft is fixed and the body of the motor rotates.

Hub motors also tend to be "pancake style." As described herein, pancake motors are higher in diameter and lower in depth than most motors. Pancake style motors are advantageous for a wall mount, subfloor mount, and/or floor mount application where maintaining a low depth is desirable, such as a piece of fitness equipment to be mounted in a consumer's home or in an exercise facility/area. As described herein, a pancake motor is a motor that has a diameter higher than twice its depth. As one example, a pancake motor is between 15 and 60 centimeters in diameter, for example, 22 centimeters in diameter, with a depth between 6 and 15 centimeters, for example, a depth of 6.7 centimeters.

Motors may also be "direct drive," meaning that the motor does not incorporate or require a gear box stage. Many motors are inherently high speed low torque but incorporate an internal gearbox to gear down the motor to a lower speed with higher torque and may be called gear motors. Direct drive motors may be explicitly called as such to indicate that they are not gear motors.

If a motor does not exactly meet the requirements illustrated in the table above, the ratio between speed and torque may be adjusted by using gears or belts to adjust. A motor coupled to a 9" sprocket, coupled via a belt to a spool coupled to a 4.5" sprocket doubles the speed and halves the torque of the motor. Alternately, a 2:1 gear ratio may be used to accomplish the same thing. Likewise, the diameter of the spool may be adjusted to accomplish the same.

Alternately, a motor with 100× the speed and 100th the torque may also be used with a 100:1 gearbox. As such a gearbox also multiplies the friction and/or motor inertia by 100×, torque control schemes become challenging to design for fitness equipment/strength training applications. Friction may then dominate what a user experiences. In other applications friction may be present, but is low enough that it is compensated for, but when it becomes dominant, it is difficult to control for. For these reasons, direct control of motor torque is more appropriate for fitness equipment/strength training systems. This would typically lead to the selection of an induction type motor for which direct control of torque is simple. Although BLDC motors are more directly able to control speed and/or motor position rather than torque, torque control of BLDC motors can be made possible when used in combination with an appropriate encoder.

Trainer Intelligence.

When a user is performing an exercise, the part of their body being exercised moves through a range of motion necessary to perform that exercise. For example, a bicep exercise might move from the elbow being fully extended wherein the bicep muscle is fully elongated, to the elbow being fully bent wherein the bicep is fully contracted. This presents an opportunity for "Trainer Intelligence" as described below.

In some embodiments, for a user performing the exercise with the system of FIG. 1A, during this motion the cable (1008) may move through a range of motion which corresponds to a range of motion for the cable (1008), spool, and motor (1006) of the system, if a motor is being used. In some embodiments, changes in cable (1008) position may correspond to changes in the readings of various sensors and in the physical position of various actuators such as linear electro-magnetic-mechanical, pneumatic, and so forth. This range of motion is termed "percent range of motion", which ranges from 0% to 100%, with the convention that 0% represents the beginning of the range of motion when the elbow is fully extended, and 100% represents the end of the range of motion when the elbow if fully bent. Both actual and ideal range of motion is considered. Actual range of motion is that a current user enacts, and ideal range of motion is that which a user should enact for an ideal or intended exercise.

Strength training exercises are divided into sets. Each set includes one or more repetitions. A user typically performs one or more sets of a given exercise. In order to determine a percent range of motion, the systems in FIG. 1A may first calibrate itself, and may then also make dynamic adjustments. This is possible because the user performs several repetitions of every movement. The first time a user performs a given movement/exercise, a start position, an end position, and stride length, the end position minus the start position, may be recorded. The end position may be the point at which the direction of movement changes from the direction corresponding to the weight stack moving away from the ground to the direction corresponding to the weight stack moving towards the ground. The start position may be the point at which the direction of movement changes from the direction corresponding to the weight stack moving towards the ground to the direction corresponding to the weight stack moving away from the ground. In one embodiment, calibration and/or adjustment may be based on recordings from each movement in a set. Alternatively, calibration and/or adjustment may be based on recordings over multiple sets, such that the results over time are combined and stored for use in future sets.

A user may momentarily change direction of travel at a point that does not demark the beginning or end of a repetition. This may happen if a user is struggling. Such movements may be filtered out for the purposes of determining range of motion, or noted in another way.

Constantly recording and updating the start point, end point, and the calculated stride length are important to calculations. Points change over time, as a user taking a step away from the machine shifts the start and end points the equivalent distance. If the stride length has not changed, the true range of motion may not be changed but be offset, which may be filtered or dealt with appropriately with a calculated offset. The start points and end points may be updated with each repetition, or an average, moving average, or weighted average of the last plurality of recorded samples are used, and may include samples from previous sets.

In some embodiments, range of motion and repetitions are extracted from a series of position updates. Hysteresis is used to filter out small movements that may be mistaken for a new repetition, such as when a user is struggling, and this learns over time by averaging the position of the start and end of the range of motion. Averaging may also occur over weighted averages and/or moving averages. Sample code includes:

```
// Repetition Extraction from position data. (this function is to be called every time the
// position of the virtual weight stack changes). It will extract segments (each rep is 2
// segments), and calculate the position in (% of range of motion) as it learns the range
// of motion.
void processRe(int32 newpos) {
  // newpos is the virtual position of the weight stack at the current moment. GROUND is a
  // constant that indicates the lowest possible position the weight stack can take.
  // g_ReEndSetFlag is a global flag that indicates to this rep extraction algorithm that
  // the current set has come to an end, an a new set should begin. This can be user initiated
  // or be based on a timer (when newpos <= GROUND, start a timer, and if the weight stack
  // doesn't move above ground after a certain amount of time threshold (say 10 seconds), we
  // can declare the set over.
  if(g_ReEndSetFlag && newpos <= GROUND) {
    g_ReSegCount = 0; // which will trigger a full reset in the if statement below
    g_ReEndSetFlag = 0;
  }
  if(g_ReLow >= g_ReHigh && g_ReSegCount > 0) {
    g_ReSegCount = 0;
  }
```

-continued

```
// Now we're starting a new set!
if(newpos <= GROUND && g_ReSegCount <= 0) {
  g_ReDirUp = 1; // the direction the weight stack is moving (up or down)
  g_ReSegUp = 1; // each rep has two segments, an up and a down segment. This stores
                 // the direction of the current segment
  g_RePos = GROUND; // the previous position of the weight stack
  g_RePercent = 0; // percent position into the range of motion. 0% is the start of the
                 // range of motion, and 100% is the end of the range of motion
  g_ReSegCount = 0; // counts the number of segments (2 segments per rep)
  g_ReLow = GROUND; // This is the position of the (average) beginning of the range of motion
  g_ReHigh = -1; // Like ReLow, but it's the end; -1 => we won't use these until initialized
  // The next two thresholds are used to implement hysteresis, were the weight stack reversing
  // direction does not count as a new segment unless it's gone past the appropriate threshold
  g_ReHighThreshold = -1; // The threshold for going from Up to Down
  g_ReLowThreshold = -1; // The threshold for going from Down to Up
  g_ReFlag = 0; // A flag that indicates that a change in direction was ignores because it
               // didn't comply with one of the above two thresholds
  g_RePercent = 0; // Global, and the output of this function; represents the position as
                 // a percent of range of motion
  return;
} else if(newpos < GROUND) {
  newpos = GROUND; // filter out what happens down there ;)
}
if(g_ReLow >= g_ReHigh && g_ReSegCount > 0) {
  g_RePercent = 0; // This should never happen
} else if(g_ReSegCount < 2) {
  g_RePercent = 0; // percent isn't useful until a full repetition has completed (that's 2
  // segments; one on the way up, and one on the way down
} else {
  // Muliply by 1000 since we are calculating 10th's of a percent (fixed point)
  g_RePercent = (int)((int32)(newpos - g_ReLow) * (int32)1000L / (int32)(g_ReHigh - g_ReLow));
}
if(g_ReDirUp) {
  if(newpos < g_RePos) {
    // wow, direction changed!
    g_ReDirUp = 0;
    if(g_ReFlag) {
      g_ReFlag = 0;
    } else if(newpos < g_ReHighThreshold && g_ReSegCount > 1) {
      g_ReFlag = 1;
      g_ReFlagCount++;
    } else if(newpos < 6000 && g_ReSegCount == 0) {
      g_ReFlag = 1;
      g_ReFlagCount++;
    } else {
      // Let's record the "high" position
      if(g_ReSegCount < 2) {
        g_ReHigh = g_RePos; // first segment, just record
      } else {
        // Moving average for future segments
        g_ReHigh = (g_ReHigh * 3 + g_RePos * 7) / 10;
      }
      // We have a new high point; let's update the thresholds
      g_ReHighThreshold = (g_ReLow + (int32)2L*g_ReHigh) / (int32)3L;
      g_ReLowThreshold = ((int32)2L*g_ReLow + g_ReHigh) / (int32)3L;
      if(g_ReSegCount == 0) {
        // First half of the first rep; let's set the low threshold
        // such that minimum rep length is 10 cm
        g_ReLowThreshold = g_ReHighThreshold - g_AsTicksPerMm * 100L;
      }
      g_ReSegCount++;
      g_ReFlag = 0;
      g_ReFlagCount = 0;
      g_ReSegUp = g_ReDirUp;
      g_ReFlagGround = 0; // reset the ground flag
      // Notify a listener that a up segment has completed (this is a place where
      // any code relying on repetition extraction can make decisions at the end of a
      // up segment)
      onReEndOfUpSegment(newpos);
    }
  }
} else {
  if(newpos > g_RePos) {
    // wow, direction changed!
    g_ReDirUp = 1;
```

-continued

```
        if(g_ReFlag) {
          TEST_PRINTF(": %-10d LOW\n", g_RePos);
          g_ReFlag = 0;
        } else if(newpos > g_ReLowThreshold && g_ReSegCount > 0) {
          TEST_PRINTF("! %-10d LOW    [Threshold = %d]\n", g_RePos, g_ReLowThreshold);
          g_ReFlag = 1;
        } else {
          // Let's record the "high" position
          if(g_ReSegCount < 2) {
            g_ReLow = g_RePos; // first segment, just record
          } else {
            // Moving average for future segments
            g_ReLow = (g_ReLow * 3 + g_RePos * 7) / 10;
          }
          // We have a new low point; let's update the thresholds
          g_ReHighThreshold = (g_ReLow + 2*g_ReHigh) / 3;
          g_ReLowThreshold = (2*g_ReLow + g_ReHigh) / 3;
          g_ReSegCount++;
          g_ReFlag = 0;
          g_ReFlagCount = 0;
          g_ReSegUp = g_ReDirUp;
          // Notify a listener that a down segment has completed (this is a place where
          // any code relying on repetition extraction can make decisions at the end of a
          // down segment)
          onReEndOfDownSegment(newpos);
        }
      } else if(newpos <= GROUND) {
        if(!g_ReFlagGround) {
          // Notify a listener that the weight stack has reached the ground (this is a place
          // where any code relying on repetition extraction can make decisions that are to be
          // make when the weight stack returns to the ground)
          onRegGround( );
        }
        g_ReFlagGround = 1;
      }
    }
    g_RePos = newpos;
}
```

Significant changes in stride are noted as they indicate that the user is not completing the full range of motion on the exercise. This is particularly true if the start point is the same, but the end point has changed resulting in a reduced range of motion. This may be an indication of a user that is fatigued or being lazy.

In some embodiments, significant changes in stride are detected through the use of thresholds. For example, a reasonable range of motion for a healthy repetition begins at between 0% and 10%, and ends at between 90% and 100%. If the user ends a repetition at a lower point, such as 83% rather than greater than 90%, then this is considered a significant reduction in range of motion, at which point a user may be alerted and/or coached.

The concentric phase of an exercise is reflected when range of motion is increasing, for example 0% to 100%, and the eccentric phase of an exercise is reflected when range of motion is decreasing, for example from 100% to 0%. The bounds of 0% and 100% need not be actually reached as the user may be lazy or exceeding their average. When range of motion changes from increasing to decreasing, or decreasing to increase, is sufficient to determine a transition from concentric to eccentric or eccentric to concentric.

Figure 1B:
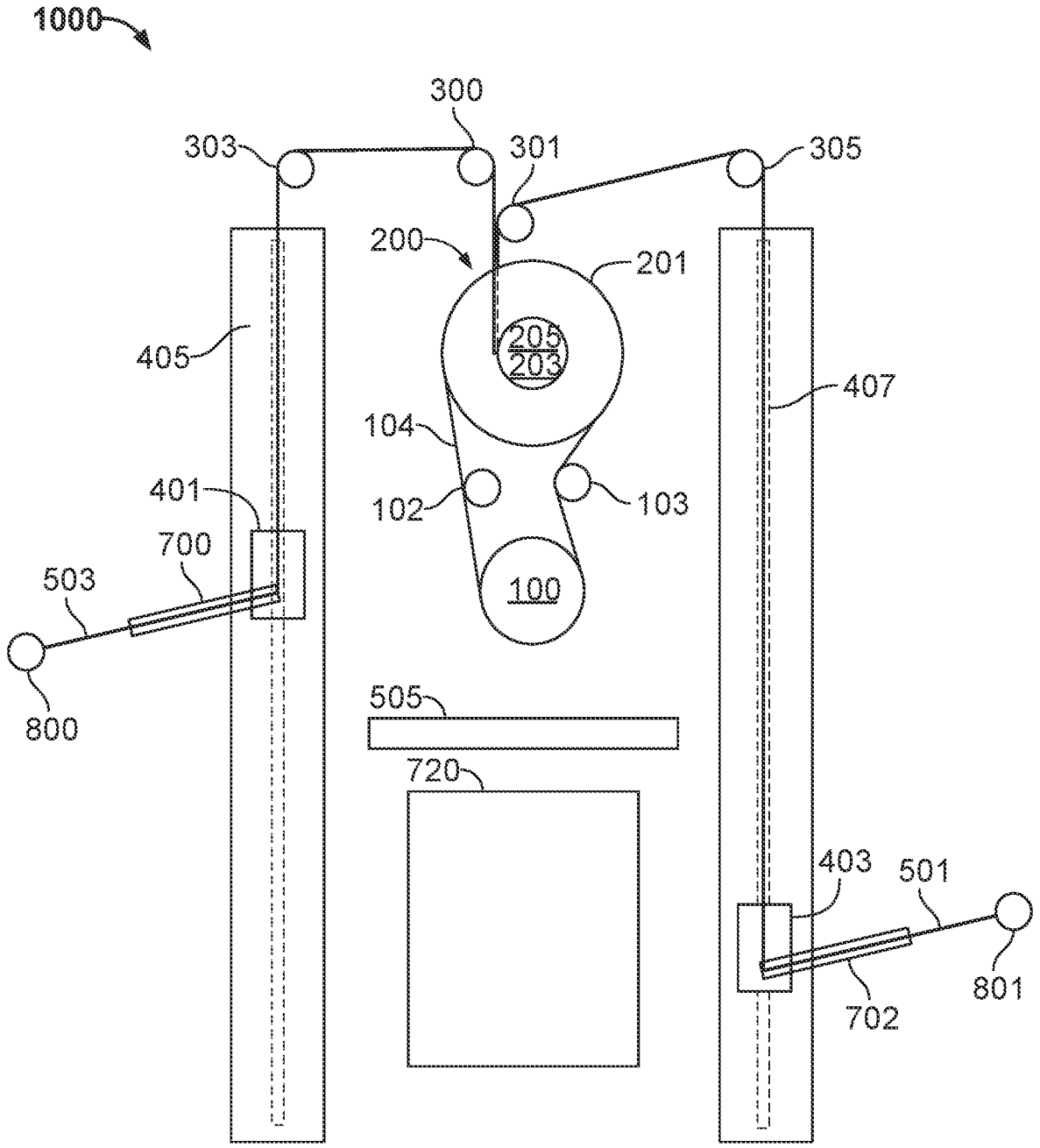
FIG. 1B illustrates a front view of one embodiment of an exercise machine.

FIG. 1B illustrates a front view of one embodiment of an exercise machine. In some embodiments, exercise machine 1000 of FIG. 1B is an example or alternate view of the exercise machine of FIG. 1A. In this example, exercise machine (1000) includes a pancake motor (100), a torque controller coupled to the pancake motor, and a high resolution encoder coupled to the pancake motor (102). As used herein, a "high resolution" encoder refers to an encoder with 30 degrees or greater of electrical angle. In this example, two cables (503) and (501) are coupled respectively to actuators (800) and (801) on one end of the cables. The two cables (503) and (501) are coupled directly or indirectly on the opposite end to the motor (100). While an induction motor may be used for motor (100), a BLDC motor may also be used for its cost, size, weight, and performance. In some embodiments, a high resolution encoder assists the system to determine the position of the BLDC motor to control torque. While an example involving a single motor is shown, the exercise machine may include other configurations of motors, such as dual motors, with each cable coupled to a respective motor.

Sliders (401) and (403) may be respectively used to guide the cable (503) and (501) respectively along rails (405) and (407). The exercise machine in FIG. 1B translates motor torque into cable tension. As a user pulls on actuators (800) and/or (801), the machine creates/maintains tension on cable (503) and/or (501). The actuators (800, 801) and/or cables (503, 501) may be actuated in tandem or independently of one another.

In one embodiment, electronics bay (720) is included and has the necessary electronics to drive the system. In one embodiment, fan tray (505) is included and has fans that cool the electronics bay (720) and/or motor (100).

Motor (100) is coupled by belt (104) to an encoder (102), an optional belt tensioner (103), and a spool assembly (200). In one embodiment, motor (100) is an out-runner, such that the shaft is fixed and the motor body rotates around that shaft. In one embodiment, motor (100) generates torque in the counter-clockwise direction facing the machine, as in the example in FIG. 1B. Motor (100) has teeth compatible with the belt integrated into the body of the motor along the outer circumference. Referencing an orientation viewing the front of the system, the left side of the belt (104) is under tension, while the right side of the belt is slack. The belt tensioner (103) takes up any slack in the belt. An optical rotary encoder (102) coupled to the tensioned side of the belt (104) captures all motor movement, with significant accuracy because of the belt tension. In one embodiment, the optical rotary encoder (102) is a high resolution encoder. In one embodiment, a toothed belt (104) is used to reduce belt slip. The spools rotate counter-clockwise as they are spooling cable/taking cable in, and clockwise as they are unspooling/releasing cable out.

Spool assembly (200) comprises a front spool (203), rear spool (205), and belt sprocket (201). The spool assembly (200) couples the belt (104) to the belt sprocket (201), and couples the two cables (503) and (501) respectively with spools (205) and (203). Each of these components is part of a low profile design. In one embodiment, a dual motor configuration not shown in FIG. 1B is used to drive each cable (503) and (501). In the example shown in FIG. 1B, a single motor (100) is used as a single source of tension, with a plurality of gears configured as a differential are used to allow the two cables/actuators to be operated independently or in tandem. In one embodiment, spools (205) and (203) are directly adjacent to sprocket (201), thereby minimizing the profile of the machine in FIG. 1B.

As shown in FIG. 1B, two arms (700, 702), two cables (503, 501) and two spools (205, 203) are useful for users with two hands, and the principles disclosed without limitation may be extended to three, four, or more arms (700) for quadrupeds and/or group exercise. In one embodiment, the plurality of cables (503, 501) and spools (205, 203) are driven by one sprocket (201), one belt (104), and one motor (100), and so the machine (1000) combines the pairs of devices associated with each user hand into a single device. In other embodiments, each arm is associated with its own motor and spool.

In one embodiment, motor (100) provides constant tension on cables (503) and (501) despite the fact that each of cables (503) and (501) may move at different speeds. For example, some physical exercises may require use of only one cable at a time. For another example, a user may be stronger on one side of their body than another side, causing differential speed of movement between cables (503) and (501). In one embodiment, a device combining dual cables (503) and (501) for a single belt (104) and sprocket (201) retains a low profile, in order to maintain the compact nature of the machine, which can be mounted on a wall.

In one embodiment, pancake style motor(s) (100), sprocket(s) (201), and spools (205, 203) are manufactured and arranged in such a way that they physically fit together within the same space, thereby maximizing functionality while maintaining a low profile.

As shown in FIG. 1B, spools (205) and (203) are respectively coupled to cables (503) and (501) that are wrapped around the spools. The cables (503) and (501) route through the system to actuators (800) and (801), respectively.

The cables (503) and (501) are respectively positioned in part by the use of "arms" (700) and (702). The arms (700) and (702) provide a framework for which pulleys and/or pivot points may be positioned. The base of arm (700) is at arm slider (401) and the base of arm (702) is at arm slider (403). In some embodiments, the arms pivot vertically, with the pivot point being at the base of the arm. In some embodiments, the arm is mounted to the slider, which is able to slide or translate vertically up and down along the rail/track. This allows the position of an actuator to be adjusted along the vertical z-axis. In some embodiments, the rail/track rotates, allowing the arms to be pivoted/positioned horizontally.

The cable (503) for a left arm (700) is attached at one end to actuator (800). The cable routes via arm slider (401) where it engages a pulley as it changes direction, then routes along the axis of rotation of track (405). At the top of rail/track (405), fixed to the frame rather than the track, is pulley (303) that orients the cable in the direction of pulley (300), that further orients the cable (503) in the direction of spool (205), wherein the cable (503) is wound around spool (205) and attached to spool (205) at the other end.

Similarly, the cable (501) for a right arm (702) is attached at one end to actuator (801). The cable (501) routes via slider (403) where it engages a pulley as it changes direction, then routes along the axis of rotation of rail/track (407). At the top of the rail/track (407), fixed to the frame rather than the track is pulley (305) that orients the cable in the direction of pulley (301), that further orients the cable in the direction of spool (203), wherein the cable (501) is wound around spool (203) and attached to spool (203) at the other end.

One use of pulleys (300, 301) is that they permit the respective cables (503, 501) to engage respective spools (205, 203) "straight on" rather than at an angle, wherein "straight on" references being within the plane perpendicular to the axis of rotation of the given spool. If the given cable were engaged at an angle, that cable may bunch up on one side of the given spool rather than being distributed evenly along the given spool.

In the example shown in FIG. 1B, pulley (301) is lower than pulley (300). This demonstrates the flexibility of routing cables. In one embodiment, mounting pulley (301) leaves clearance for certain design aesthetic elements that make the machine appear to be thinner.

In one embodiment, the exercise machine/appliance passes a load/resistance against the user via one or more lines/cables, to a grip(s) (examples of an actuator) that a user displaces to exercise. A grip may be positioned relative to the user using a load arm and the load path to the user may be steered using pulleys at the load arm ends, as described above. The load arm may be connected to a frame of the exercise machine using a carriage that moves within a track that may be affixed to the main part of the frame. In one embodiment, the frame is firmly attached to a rigid structure such as a wall. In some embodiments, the frame is not mounted directly to the wall. Instead, a wall bracket is first mounted to the wall, and the frame is attached to the wall bracket. In other embodiments, the exercise machine is mounted to the floor. The exercise machine may be mounted to both the floor and the wall for increased stability. In other embodiments, the exercise machine is a freestanding device.

In some embodiments, the exercise machine includes a media controller and/or processor, which monitors/measures user performance (for example, using the one or more sensors described above), and determines loads to be applied to the user's efforts in the resistance unit (e.g., motor described above). Without limitation, the media controller and processor may be separate control units or combined in a single package. In some embodiments, the controller is further coupled to a display/acoustic channel that allows instructional information to be presented to a user and with which the user interacts in a visual manner, which includes communication based on the eye such as video and/or text or icons, and/or an auditory manner, which includes communication based on the ear such as verbal speech, text-to-speech synthesis, and/or music. Collocated with an information channel is a data channel that passes control program information to the processor which generates, for example, exercise loading schedules. In some embodiments, the display is embedded or incorporated into the exercise machine, but need not be (e.g., the display or screen may be separate from the exercise machine, and may be part of a separate device such as a smartphone, tablet, laptop, etc. that may be communicatively coupled (e.g., either in a wired or wireless manner) to the exercise machine). In one embodiment, the display is a large format, surround screen representing a virtual reality/alternate reality environment to the user; a virtual reality and/or alternate reality presentation may also be made using a headset.

In one embodiment, the appliance media controller provides audio information that is related to the visual information from a program store/repository that may be coupled to external devices or transducers to provide the user with an auditory experience that matches the visual experience. Control instructions that set the operational parameters of the resistance unit for controlling the load or resistance for the user may be embedded with the user information so that the media package includes information usable by the controller to run the machine. In this way a user may choose an exercise regime and may be provided with cues, visual and auditory as appropriate, that allow, for example, the actions of a personal trainer to be emulated. The controller may further emulate the actions of a trainer using an expert system and thus exhibit artificial intelligence. The user may better form a relationship with the emulated coach or trainer, and this relationship may be encouraged by using emotional/mood cues whose effect may be quantified based on performance metrics gleaned from exercise records that track user performance in a feedback loop using, for example, the sensor(s) described above.

Assisted Controlling of Digital Weight

Various control mechanisms may be used to rack (e.g., load) or unrack (e.g., unload) the digital weight described above. As one example, the handles may be smart accessories that include buttons or other types of controls via which the user may activate to explicitly indicate whether they would like to rack or unrack the digital weight. For example, the smart handles may include a button that the user presses on to explicitly indicate whether they would like to rack or unrack the digital weight (and thereby control where the motor activates or not). In another embodiment, the exercise machine is always loaded (with the motor providing resistance), in a similar way that a typical physical weight would always be present when connected in a weight stack.

The following are embodiments of controlling unracking of digital weight. The techniques described herein provide various benefits, from safety to ergonomics. For example, if the digital weight were always loaded, it may be difficult, for some moves, for a user to get into position. Consider, for example, a bench press. If the digital weight were already at the level of resistance at which the exercise is to be performed, it may be difficult for the user to get into position and pull up the handles from the ground.

While smart accessories may be used to control whether the digital weight is on or off for many exercises, there may be some exercises where there may be ergonomic challenges due to where the buttons are located on the smart accessory. For example, consider the goblet squat. Buttons on a handle or actuator may be in certain fixed locations. Depending on how the user grips a handle to perform the exercise, it may be challenging for them to press a button on the handle, given its location. Further, some accessories, such as ropes, may not be as conducive to having a button or other type of control input. Using the techniques described herein, improvements to ergonomics for controlling digital weights may be achieved, allowing users, for example, to interact with actuators in a more stable position throughout the entire range of motion (rather than, for example, having to move their hands at some point to press a button).

In some embodiments, the assisted motor control techniques described herein are based on determining a readiness of a user to accept resistance (e.g., that the user is braced and ready to accept the target resistance for an exercise), such as in the course of setting up or performing an exercise. In some embodiments, the detection of readiness is based on detecting a state of the cable(s) of the digital strength trainer. In this way, the readiness or intent of the user to begin exercise may be inferred, without the user having to provide an explicit input to a control (e.g., by pressing a button). Further details regarding detecting readiness and resistance control are described below.

Assisted Weight On (Assisted Unracking Mode)

The following are embodiments of unracking based on detected readiness. As will be shown below, the various techniques described herein provide both safety and usability when performing strength training using an exercise machine such as a digital strength trainer. For example, from the perspective of usability, the techniques described herein allow intuitive control of the exercise machine that is also ergonomically comfortable, providing the user a good experience when using the digital strength trainer.

In various embodiments, the unracking techniques described herein are implemented on embedded microcontrollers in the motor control board. For example, a PID (proportional-integral-derivative) controller is used. This allows for fast and reliable execution of the technique (as the motor control board may be run at a high frequency, and is directly connected to the motor(s) being controlled). In this way, the decisions on how to control the motor are made and executed in real time. In some embodiments, the unracking techniques described herein take as input parameters that may be determined by the computing node on the exercise machine, which may in turn determine the parameters using information from a backend.

Figure 2:
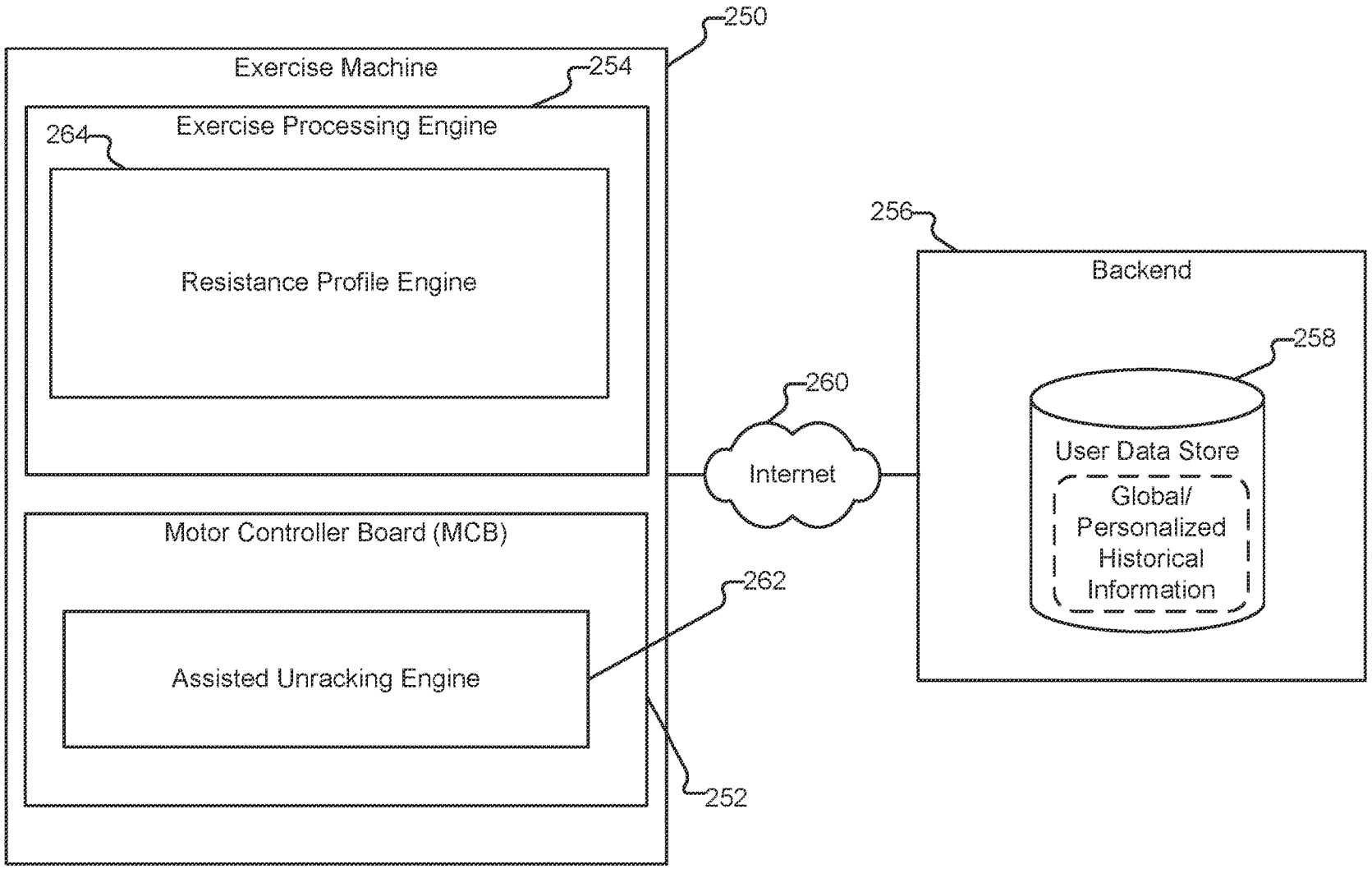
FIG. 2 illustrates an embodiment of a system for assisted unracking of digital resistance.

FIG. 2 illustrates an embodiment of a system for assisted unracking of digital resistance. As shown in this example, there are various systems that interact with each other. In this example, the exercise machine 250 includes motor controller board 252. In some embodiments, the motor control board is at the firmware/embedded hardware level and interacts with hardware components such as the motor. The exercise machine further includes exercise processing engine 254. As one example, the exercise processing engine is implemented using Android. In some embodiments, the exercise processing engine performs computations and communicates with the motor controller board. In some embodiments, the exercise machine communicates (over a network 260 such as the Internet) with a backend server 256. In some embodiments, the backend aggregates exercise data from various client exercise machines, and, for example, stores such data to data store 258. The backend may perform various processing based on such information, which may be communicated to the exercise machine for use. Each of the three systems (motor control board, exercise processing engine, and backend) operates on different timescales.

For example, the motor controller may be implemented using a PID controller, that is a tight loop that may operate on the millisecond level. This allows dynamic motor control in real time. In this example, the MCB includes assisted unracking engine 262, which is configured to perform dynamic motor control to facilitate assisted unracking of digital weights. In some embodiments, the assisted unracking engine performs motor control to adjust resistance based on measurements and samples collected from various sensors (e.g., based on motor speed and motor position measurements).

While the exercise processing engine 254 may not be able to perform real-time motor control, it may have more computational resources to determine parameters and instructions, which are sent to the motor control board, for example, at the start, during, or end of a set. In some embodiments, the exercise processing engine includes resistance profile engine 264, which is configured to determine input parameters for resistance profiles to be executed by the motor control board when determining how to control resistance provided by the motor. In some embodiments, resistance profile engine 264 is also configured to determine what resistance profile or strength curve is to be used by the motor control board. For example, the resistance profile engine is configured to send signals to the motor control board to switch between different modes of operation, to pass input parameters used by the assisted unracking techniques being executed on the motor controller, etc. As one example, the computing node may determine what type of strength curve that the motor control board should be executing, as well as the parameters for the strength/force curve. In the above example, the MCB and the computing node operate in conjunction to implement the selection and execution of what force curve to execute and with what parameters. In other embodiments, the selection and execution of the force curve is implemented by one of the computing node or the MCB.

The backend may perform various other types of processing, such as pre-processing of personalized historical data to predict the user's range of motion, to predict the first maximum range of motion, predict the speed at which the user may perform a repetition, etc. Such information may be computed at the backend, which is then sent to the exercise processing engine (e.g., at the beginning of a set or a workout), where such parameters may then be forwarded by the exercise processing engine to the motor control board, which implements the motor control loop. For example, such parameters may be used as inputs to the strength curve or profile executed by the motor control board to facilitate assisted unracking of digital weights.

The following are embodiments of techniques for assisted unracking of digital weights.

Speed-Based Unracking

In various embodiments, the unracking is implemented using a single or multi-profile ramp. For example, to determine user readiness, the digital strength trainer provides isokinetic resistance during a first portion or segment of a concentric phase of a repetition of an exercise (e.g., when a user is pulling the cable out, working against the motor). Providing isokinetic resistance includes controlling the motor(s) to force the user to move at a fixed speed (e.g., by controlling the speed at which they extend or retract the cables). This includes adjusting the torque of the motor to either speed up or slow down the user in order to maintain a target speed. For example, the exercise machine is configured to keep the user at a fixed speed through a concentric phase of a repetition, providing the user only as much weight as they can move. If the user begins to struggle, then the cable speed will fall below the target speed. In this case, the motor is controlled to reduce resistance to allow the user to move faster again. This is an example of a closed control system that prevents the weight/resistance from going too high. If the user moves at a speed such that the cable speed is above the target speed, then the amount of resistance provided by the motor is increased to slow the user down.

In some embodiments, the assisted unracking mechanism described herein places a cap, upper bound, or upper threshold on the maximum weight or resistance that the motor can provide during the isokinetic phase. If the user hits that maximum weight (e.g., by pulling on the cable at a speed that exceeds the target speed when the motor is providing resistance at the maximum weight), then the motor controller is switched from using an isokinetic force-speed curve to using a different weight profile, such as a target weight profile (in which, for example, the target weight of the user is applied). The target weight may be a suggested weight for an exercise. There are various beneficial properties of using such a multi-profile torque application technique, which may be used to satisfy various safety issues or constraints.

As one example, via such a multi-profile unracking technique, the exercise machine does not provide more resistance/weight than the user has proven to the exercise machine that they can actually move. For example, by having an isokinetic portion of the unracking technique, if the user is unable to move the cable at a target weight (e.g., by determining that the observed cable speed is below the target speed when the motor is providing a certain amount of resistance), then, according to the isokinetic strength curve, the resistance will be lowered before the target weight profile comes into effect or is switched to.

If the user is able to move at the maximum weight (indicated by the user being able to move the cable at or faster than the target speed when the motor is at the target weight), then the weight is clipped (and the motor does not provide greater resistance to slow the user down). This is an indication, to the exercise machine, that the user is ready to accept the target resistance for performing exercise.

In some embodiments, the exercise machine (e.g., via a PID controller) uses an exponential moving average to track the isokinetic speed, and when the user's behavior has settled to a target weight, the motor controller switches from operating in the isokinetic mode to providing a second weight profile for use when performing the exercise.

The samples used by the PID controller to determine how to control the motor resistance may be noisy. In some embodiments, rather than switching force curves when an instantaneous force reaches/exceeds the target (where noise in sensor measurements may cause the switching of the force curve to occur too early), the exponential moving average described above is used as a filter on the observed user force being applied, so that the exercise machine determines whether the user is able to sustain being at the target weight, before the exercise machine controls the motor torque to be at that target resistance.

As shown in the above examples, in some embodiments, the PID controller takes as input the monitored speed of the cable. Based on the cable speed, the PID controller determines and provides as output a weight or amount of torque that the motor is to provide. In some embodiments, the force applied by the user is determined (e.g., via a tensiometer). In some embodiments, encoders in the motor are used to determine motor position. The output is used by the motor control board to control how much resistance is provided to the user.

When the user is able to move the cable at or faster than the target speed when the motor is at the target weight, the user has demonstrated to the exercise machine that they are able to lift the target weight. In some embodiments, during the isokinetic readiness-detection phase, if at any point the user struggles (e.g., by detecting that the cable speed is below the target speed), then the weight is lowered immediately (e.g., within a millisecond, based on the implementation of the unracking technique on the microcontrollers of the motor control board) to a weight that the user is able to handle. If the user stops completely, the torque on the motor is dropped to a minimum value quickly.

Consider, for example, the goblet squat. Suppose that the user has picked up the handle. The motor is configured to start by providing a nominal amount of resistance (e.g., five pounds). Suppose that the isokinetic profile is set with a target isokinetic speed of two inches per second (any other target isokinetic speed may be used, as appropriate). When the user is first getting into position, the motor is providing the nominal amount of resistance. As the user begins the concentric phase, (e.g., by straightening upwards, causing the cable to be extended), the exercise machine will attempt to keep the user at the target isokinetic speed of two inches per second.

In some embodiments, the target isokinetic speed is selected to allow for testing of the user readiness to accept resistance. The target isokinetic speed may be set lower than what a user would typically perform an exercise repetition at (e.g., a speed that a user would more naturally perform the exercise at). The typical speed that the user moves at may be determined in a variety of ways. As one example, the speed is personalized and based on historical cable speed measurements taken from the user's previous exercise sessions. Each move may have a corresponding personalized typical cable speed. The typical speed may also be determined as a global parameter. The typical speed need not be personalized. Machine learning may also be used to facilitate determination of the target speed thresholds described herein.

In this example, the exercise machine will attempt to keep the user moving at the target isokinetic speed until the exercise machine detects the user's readiness to perform the exercise (e.g., by detecting that the user is able to pull the handle or apply force at the target weight). Once the exercise machine detects that the user is able to apply force at the target weight (say, for example, 100 pounds) at more than two inches per second, then the exercise machine switches to the target weight profile (e.g., profile used by the exercise machine for when the user is actively performing the exercise), which, for example, may include locking in the target weight. At this point, the machine is fully loaded at the target weight of 100 pounds for the exercise. If a higher target isokinetic speed were used, this may result in the target speed being higher than what the user normally moves at, in which case they may never exceed the target isokinetic speed (in which case, the weight would never be increased to the maximum weight being tested for during the readiness detection). Here, application of user force at a target weight and at a target cable speed is monitored for to determine the user's readiness to accept an exercise resistance. In some embodiments, the target isokinetic speed is selected to balance the sensitivity of how quickly the resistance is modulated, versus how easily the cable is typically moved.

As described above, in various embodiments, the assisted unracking mode described herein utilizes an isokinetic force-speed profile with a clipped maximum weight that automatically switches to a second resistance/weight profile based on detection of user readiness (which is tested, for example, by determining when the user is able to apply force at the target weight at (or above) the target isokinetic speed). Here, the exercise machine dynamically switches between resistance profiles, automatically adjusting the weight in a manner that aligns with the user's readiness to perform the exercise.

The following are further embodiments of speed-based unracking techniques. Users typically only move with sustained high speeds while performing actual repetitions. For example, users tend to move more slowly (or not at all) when getting into position or resting between sets. In some embodiments, in a speed-based unracking scheme, when the speed is low, the digital resistance is set to be relatively low for safety.

The following are embodiments of speed-based unracking for moves that start at the minimum of the range of motion (e.g., bicep curls):

1. Turn the weight on when not grounded and set base_weight (e.g., nominal weight) to five lbs/arm (e.g., in an embodiment of a strength trainer with two arms). In some embodiments, initialize state variables:
   a. safe_position=position
   b. safe_weight as the current base weight (e.g., nominal starting weight, such as five lbs, or any other weight as appropriate).
   c. position_at_last_safe_update=position
2. In some embodiments, while position>safe_position (e.g., cable position threshold) remains true, then weight scales proportionally with speed following the equation below, and may only increase. One example of a default max_speed is 15 in/s/arm.
   a. candidate_base_weight=(starting_base_weight−5)*(speed/max_speed+5)//this is an example of an intermediate variable
   b. base_weight=MIN(starting_base_weight, MAX(base_weight, candidate_base_weight))
   c. Note: In some embodiments, the user has demonstrated the ability to lift this weight safely at this position by doing so with speed>0.
3. In some embodiments, when base_weight>1.1*safe_weight, then update the state
   a. safe_weight=(safe_weight+base_weight)/2
   b. safe_position=(position_at_last_safe_update+position)/2
   c. position_at_last_safe_update=position
4. In some embodiments, when position<safe_position, then reduce the weight proportionally with position over a window.
   a. In some embodiments, if the user goes below the bottom of the position window, then return to step 1 with all the state variables cleared: safe_position, safe_weight, and position_at_last_safe_update.
5. In some embodiments, when a rep is detected, the starting_base_weight and digital weight modes are applied.
   a. In some cases, the base_weight is equal to the starting_base_weight already. In the cases where base_weight is less, the user has moved very slowly.

In some embodiments, for moves that start at the maximum of the range of motion (e.g., bench press, squats, etc.), the logic described above is utilized, but the starting first eccentric phase is not necessarily at the full weight. For example, the above logic is performed on the first concentric phase (where a default amount of resistance is applied during the first eccentric phase, which is the first phase that the user will go through when starting exercise, as they are starting from the top of the range of motion, and letting the cable move back (retract) towards the exercise machine). In some embodiments, for the first concentric phase (e.g., when the user is getting into position), a nominal weight or resistance is provided. The nominal weight provided during the first concentric phase may be different from the resistance provided during the first eccentric phase. In some embodiments, the isokinetic-based resistance application then starts on the second concentric phase.

Setup

In some embodiments, the exercise machine determines when to activate the assisted unracking mode. Suppose, for example, that an initial state, is when the cable attached to a handle is fully retracted into the arm. To set up, the user may wish to move around and manipulate their position to get into a ready position to start the exercise. If the isokinetic-based unracking assistance mode were on from the outset, then the user would be attempting to get into position (which may include moving the handle about, causing the cable to extend or retract) while also being limited to pulling the cable at the target isokinetic speed. This may make it difficult for the user to get into position (e.g., it may take them a long time to pick up the handle and get into position).

One option to address this is to have the isokinetic-based unracking mode on, but with a target isokinetic speed that allows for relative ease of getting into position.

As another embodiment, a heuristic or other parameter is placed on top of the isokinetic-based unracking mode to determine when the mode should be automatically entered into. The automated invocation of the isokinetic-based unracking mode may depend on a variety of factors, which may depend on the type of exercise being performed.

As one example, the goblet squat typically starts and ends at the top of the user's range of motion (e.g., at maximum cable extension). In some embodiments, the exercise machine leaves the resistance at a nominal weight (or some other weight that does not hinder the user's ability to get into position) until the user moves up and comes down a certain amount (e.g., a certain number of feet of concentric cable movement, plus another number of feet of eccentric cable movement). This pattern of cable movement is monitored for by the exercise machine, where if the pattern of cable movement is observed, the exercise machine determines that the user has gone through the motions of getting into position, at which point the isokinetic-based unracking mode described above is switched on. Different exercises may be associated with different expected patterns or behaviors of cable movement that are indicative of the user getting into position and that they are ready to start.

Thus, the exercise machine may allow a higher cable speed (e.g., five inches per second) while setting up (to allow them to set up more quickly) than if the lower target isokinetic speed (e.g., two inches per second) were enforced, which could make the process of setting up frustrating.

In some embodiments, during the setup mode (or setup portion of an isokinetic mode), a higher cable speed threshold is used. The threshold speed is selected such that it is unlikely for the user to move fast enough to meet the threshold, in which the motor will not increase resistance, allowing the user to set up smoothly. In other embodiments, rather than (or in addition to) using a high speed threshold, the motor is turned off (or a nominal resistance is provided) until it is detected that setup by the user is complete, at which point the exercise machine switches to the isokinetic unracking profile.

Thus, in some embodiments, a pre-requisite of activating or initiating the assisted unracking mode is to determine that the user is detected as having gotten into position. In this case, the first detected concentric phase for an exercise such as a goblet squat or bench press is not actually the rep, but the user getting into position. The isokinetic mode would then be initiated on the first concentric phase that is subsequent to the exercise machine detecting that the user has completed setup (and gotten into position).

As described above, in some embodiments, when the user begins their exercise, the exercise machine enters a setup mode, where the exercise machine detects whether the user is ready to start by monitoring for certain types of expected cable behavior that are indicative of the person starting or getting into position. Different exercises may be associated with different cable behaviors. During setup mode, when the user is getting into position, a force curve (according to which the motor torque is controlled) used during the setup mode is different from the curve/profile used during the isokinetic unracking.

After it is determined that the person is set up, in some embodiments the exercise machine switches to the isokinetic unracking mode described above, which, in some embodiments, has a lower target speed than a threshold speed set for the setup phase.

In some embodiments, if the user is going too slowly and does not reach the target weight (because the motor is not triggered to increase resistance up to that point), then if the exercise machine detects that the user has performed a certain number of repetitions, the exercise machine boosts the resistance to the target weight.

In some embodiments, the assisted isokinetic-based unracking mode is not enabled until a setup heuristic is met (e.g., set of cable behaviors is detected). For example, in the case of a goblet squat, the assisted unracking mode is off when the user picks up the handle. The assisted mode may also be turned off when the user is at the top of their range of motion (and are entering into the eccentric phase). When the user is partway down through their first eccentric phase, the assisted unracking mode may be turned back on, such that when they start moving upwards again, the isokinetic profile is in effect. In this example, the user has not hit their target weight on the first concentric phase. Another example heuristic is holding the weight in an expected range, where this example heuristic may be personalized based on the user's historical movement, as well as their height.

Boosting to the Target Weight

In some embodiments, even if the user does not meet the maximum or target or ceiling weight during the isokinetic portion of the unracking technique, if the user completes a threshold number of repetitions of the exercise (e.g., two or three reps), then the exercise machine switches to the target weight profile (e.g., at the top of a rep). In this way, even if the user never achieves the maximum weight, the exercise machine adjusts the torque on the motor to boost the resistance to the target amount, and switches to the target weight profile. Here, if the user has done multiple full repetitions, and has not yet hit the target weight, they are switched to the target weight profile, and the resistance is boosted to the target weight for the exercise.

Eccentric Phase

As described above, in some embodiments, isokinetic resistance is provided on the concentric phase. In some cases, the user may not have hit the target weight in their first concentric phase. If the user had not reached the max weight yet, and the threshold number of reps for boosting the weight has not yet been reached, in some embodiments, the exercise machine provides a resistance during the eccentric phase that is based or derived on the resistance applied during the concentric phase (where the target weight is not applied, because the exercise machine has not detected that the user is ready to receive the target weight). During the eccentric phase, any appropriate resistance curve may be used. As one example, a flat resistance curve is used (e.g., a fixed weight is applied, independent of cable speed). For example, when in the eccentric phase, the motor applies a resistance weight that is a proportion of the weight that the user resisted when at the top of their repetition (e.g., at their maximum range of motion, where the cable is extended out to its furthest point within the range of motion).

As another example, during the eccentric phase, the exercise machine uses a percentage of the weight/resistance that is provided at the top of their rep (max of the range of motion). In some embodiments, an average is used. As another example, the resistance provided during the eccentric phase is determined based on the resistances that were applied during the concentric phase, where, for example, the determined resistance is applied as a fixed weight on the eccentric phase.

In some embodiments, when a user enters the concentric phase of the next rep, the exercise machine switches back to the assisted isokinetic-based unracking mode to determine the user's readiness.

Output Pertaining to Assisted Unracking Mode

In some embodiments, the exercise machine provides a visualization or other type of output of the weight or resistance being applied or provided by the motor. As one example, a weight dial is presented via the screen of the exercise machine. The visualization may be adapted to indicate the state of the exercise machine, and whether it is in the assisted unracking mode. For example, the weight dial color may be changed to the color red to indicate that the assisted mode is activated. When the user hits the target or suggested weight (and the exercise machine has gone to the suggested weight resistance control curve), the dial may change to another color, such as green or white. Thus, a visual indication may be provided to indicate whether the assisted mode is currently activated or not. Other types of indications, such as audible indicators and/or haptic vibrations, may be provided as well.

The following are additional embodiments of techniques for assisted unracking of digital weights.

Time-Based Weight On

As one example, the user's readiness is indicated by the user holding the actuator still for a threshold amount of time. That is, the user signals to the exercise machine that they are ready by holding the actuator still (e.g., with zero or near-zero cable velocity) for a certain amount of time. In response to detecting this cable behavior, the exercise machine then determines that the user is ready to perform exercise, and ramps up the resistance. In some embodiments, the weight is not increased immediately, but rather ramped up as a function over time, to allow for safety and to limit the amount of jerk that is experienced by the user.

The following are further embodiments of time-based weight on techniques. In some embodiments, in a time-based scheme, after the user gets into position, the user is instructed or prompted to hold still and wait for the weight to turn on. In some embodiments, if the user continues to move, then the digital strength trainer assumes they are not yet in position. The following are example steps of the time-based weight on technique:

1. In some embodiments, when the cable is not grounded AND the cable has not been moving continuously for a threshold amount of time (e.g., two seconds) AND the weight is off, then a countdown timer is started. In some embodiments, the timer is hidden if the weight is turned on by another technique.
2. As one example, a three second countdown timer is displayed on a screen. Text may also be displayed, such as a command or prompt to the user to stay still for the weight to turn on. Auditory indications such as beeps may be outputted (e.g., a beep on every second).

In some embodiments, if the user moves during this timer period, the time-based weight on technique returns to step 1. In some embodiments, if the user turns weight on during this period, then a set begins. Other logic for dynamically adjusting resistance may be executed now that the user is ready and the resistance has been unracked.

3. In some embodiments, when the countdown ends, and if the weight is still off, then the weight is turned on (e.g., ramped up to the target or suggested weight for the exercise movement being performed by the user). From here, other logic or curves for dynamically adjusting resistance may be utilized.

The following are embodiments of techniques for determining whether a user is moving (e.g., with intent to perform exercise, versus due to noise in the cable). As one example, a determination is made whether the absolute value of the cable speed is above or below a threshold hold speed (e.g., five inches per second). If the measured cable speed is below the threshold, the user is determined to not be moving. If the measured cable speed is above the threshold, then the user is determined to be moving.

In some embodiments, the determination of whether a user is moving the cable is based on the use of a moving window of time. For example, if a rolling standard deviation of cable position over a window of time (e.g., two seconds) or number of samples (e.g., 100 position updates) is above a threshold (e.g., two inches), then the user is determined to be moving the cable. As another example, the user is determined to be moving the cable if the difference between the maximum and minimum cable positions (for one or both arms of a digital strength trainer with two arms) over a previous window of time (e.g., previous two seconds) is above a threshold (e.g., six inches). As another example, the user is determined to be moving if the exponential moving average of the absolute value of cable speed is above a threshold (e.g., five inches per second).

The techniques for determining whether a user is moving the cable may be adapted for use in various other embodiments of assisted unracking techniques described herein.

Rep-Based Weight On

The following are embodiments of rep-based weight on/unracking. In some embodiments, the resistance is ramped according to a profile that adds resistance over a span of a set of repetitions. As one example, digital weight is added linearly over a portion of the first several (e.g., two or three) repetitions (of a set of repetitions), up to the target weight for the exercise. In some embodiments, the resistance is ramped or increased as a function of total concentric cable distance (e.g., the amount that the cable has traveled across concentric phases of repetitions). The rate at which the weight is ramped as a function of concentric cable distance may be adjusted. Here, in some embodiments, the resistance is adjusted based on aggregate concentric movement over time.

Such a rep-based weight on mode has various benefits. For example, oftentimes, the first repetition of a heavy move may be difficult on users' joints. The concentric cable distance-based weight on mode described herein allows the user to ease into the exercise before exercising at the target weight. This type of ramping is not available in typical physical weight stacks, as the weight (e.g., physical weight plates) is fixed from the start of the exercise set.

The following are further embodiments of rep-based weight on. As described above, in some embodiments, the rep-based weight on scheme includes gradually increasing the weight over a certain number of repetitions. For example, the resistance is gradually increased over two repetitions so that by the start of the third repetition, the full target weight is being provided by the exercise machine, where at this point the exercise machine is confident that the user is performing their reps and is in position. In some embodiments, the rep-based weight on technique leverages the repetition detection/extraction and range of motion computations described above with respect to trainer intelligence. In some embodiments, as the first two reps are not done at the full suggested weight, the first two repetitions are not counted towards the completion of the set. In some embodiments, the volume of weight from those first reps is included in a total volume of weight lifted.

In some embodiments, when the digital weight is ungrounded (e.g., the user is pulling with a force that resists the motor, causing the cable to be extended from the arm, as if a virtual weight stack were being lifted upwards), the current base weight (e.g., the initial minimum weight from which weight ramping starts) is stored as a starting base weight. The base weight may be adjusted over time, for example, to be the max(5, min(15, 0.5*starting_base_weight)) pounds per arm. The weight is then turned "on" (e.g., the resistance is increased according to a profile such as a ramp).

In some embodiments, after the end of a second eccentric phase for movements where a repetition starts at the minimum of the range of motion, or the end of a second concentric phase for movements where a rep starts at the maximum of the range of motion, the base weight is set to the determined starting base weight. The motor control board then ramps from that starting base weight.

Extension-Based Weight On

As another example, in some embodiments, the resistance is unracked as a function of absolute cable extension (e.g., how far the cable has been extended). In this example, the exercise machine ramps up the weight from a starting weight (e.g., nominal five pounds of resistance or some other base or starting weight, as appropriate) to the target or suggested weight of the exercise as the user pulls out the cable (e.g., in concentric phase). For example, by the time the user reaches their maximum range of motion on their first repetition, the motor is controlled to provide the target amount of resistance for the exercise. In this case, the resistance provided is a function of absolute cable extension until the max (target) resistance value is reached.

In some embodiments, the ramping occurs on the first repetition. The ramping activates starting from the ungrounded position. In some embodiments, historical data about the user (or global historical data about other users) is used to determine an expected maximum range of motion for a given movement (e.g., to determine the rate at which the weight is increased as a function of cable extension given an expected maximum range of motion and target weight).

Gesture-Based Weight On

In another embodiment, the exercise machine determines user readiness by detecting the user performing a gesture indicative of the user being ready to accept the target or suggested weight for an exercise to be performed. For example, the user manipulates the actuator, causing a pattern of cable behavior that signals to the exercise machine that they are ready for the target weight to be applied by the motor. One example of such a signal is the user performing a double pull on the handles (which would register as the cable being pulled on twice, according to cable position updates). Other types of gestures, such as wiggling or twisting, may also be used. Having such an explicit signal reduces the number of false positives in determining whether to begin the process of providing the user the target weight for the exercise they are performing.

The following is an example of selecting gestures for signaling unracking, while minimizing false positives. In some embodiments, the exercise machines collect sensor measurements associated with the exercises that the users perform on those machines. This historical performance information is aggregated by a backend (e.g., backend 256). The historical performance information includes a history of cable position updates (and thus, cable motion behavior) across various types of exercise movements performed by various users. In some embodiments, when determining a candidate gesture, the gesture is back tested on historical workouts that have been performed on digital strength trainers to determine how often that gesture occurred. Those gestures that are observed to occur frequently are filtered out and excluded from use as gestures, as they are likely to result in false positives (e.g., interpreted incorrectly as a request or signal to provide the target weight for an exercise). Those gestures that do not frequently occur naturally (e.g., the frequency of occurrence is below a threshold) are selected as candidate gestures.

The following are embodiments of pull gesture-based weight on techniques. In some embodiments, in a pull gesture-based scheme, when a user wants to engage the weight (e.g., turn on the digital resistance), they, for example, pull twice on both cables. In some embodiments, in response to the detection of the double cable pull, the exercise machine engages an audible and visual countdown (e.g., of three seconds, or any other amount of time as appropriate), to turn on the digital resistance (e.g., to execute the profile for ramping resistance up to the suggested weight). In some embodiments, gestures for cancelling the signal to turn the digital resistance on are also implemented and monitored for by the exercise machine, such as moving either cable position (e.g., in a two arm/two cable exercise machine embodiment) by more than a threshold amount (e.g., six inches), or completing two additional pulls (or any other number of additional pulls, as appropriate).

Figure 3:
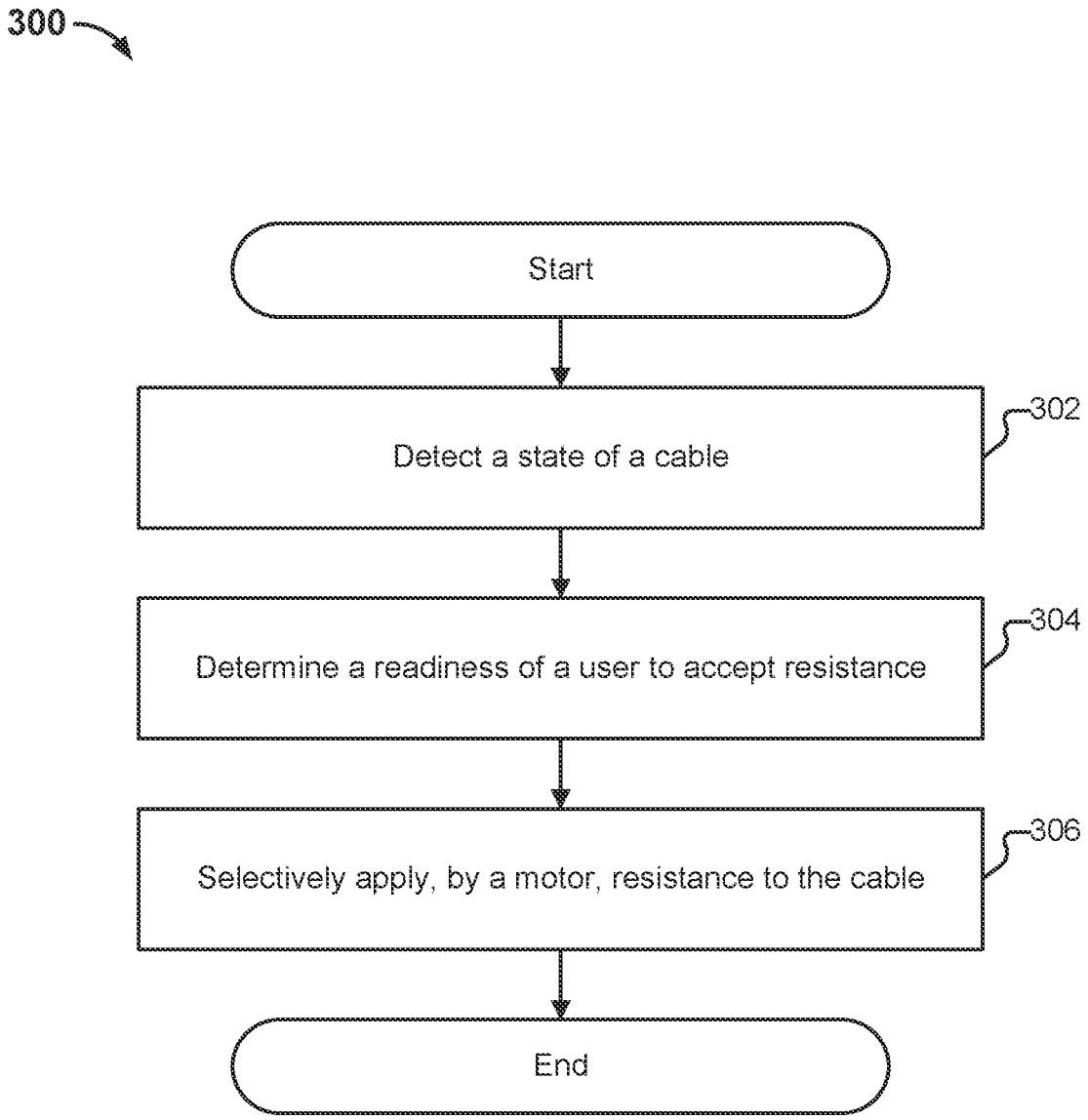
FIG. 3 is a flow diagram illustrating an embodiment of a process for assisted unracking of digital resistance.

FIG. 3 is a flow diagram illustrating an embodiment of a process for assisted unracking of digital resistance. In some embodiments, process 300 is executed by exercise machine 250 of FIG. 2. The process begins at 302 when a state of a cable is detected. In some embodiments, a motor is mechanically coupled to the cable to provide resistance during an exercise by tensioning the cable. The state of the cable may be determined during setup or performance of an exercise. Examples of state information pertaining to the cable include cable position, cable speed (or velocity), cable tension, etc. The cable state information may be determined using an encoder on a resistance mechanism such as a motor (which may be used to determine cable position and cable speed/velocity). Other examples of signals usable to determine state information pertaining to the cable include power sent to the motor, power coming out of the motor, velocity, encoder/sensor information, etc. Such sensor measurements may be correlated with each other as well.

At 304, a readiness of a user to accept resistance (e.g., in the course of setting up or performing the exercise) is determined based at least in part on the detected state of the cable.

At 306, resistance is selectively applied by the motor to the cable according to the determined readiness of the user to accept the resistance. As described in further detail above, resistance may be applied in a particular manner based on whether the user is determined to be setting up (e.g., based on a detected pattern of cable behavior), based on whether assisted unracking is being performed (e.g., via an isokinetic mode that has a clipped resistance behavior, and a speed threshold that is lower than a typical cable speed when users are performing the exercise), or based on whether the user is to be boosted up to a target weight (e.g., based on a certain number of repetitions having been completed, even if the user has not activated the target weight). For example, when in isokinetic mode, the exercise machine determines an exponential moving average of the cable velocity, as well as the current resistance that the user is operating against, where such information is used to control a PID controller to selectively control the resistance provided by the motor.

In some embodiments, the manner in which the resistance is selectively applied depends on the type of exercise that is being performed. Other examples of assisted unracking modes, as described in further detail above, include timer-based unracking, gesture-based unracking, repetition-based unracking, and cable extension-based unracking.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. An exercise machine, comprising:

a cable;

a motor mechanically coupled to the cable to provide resistance during an exercise by tensioning the cable;

a sensor that detects a state of the cable, wherein the state of the cable comprises a speed of the cable; and a controller that:

during a readiness-detection phase:

controls the resistance provided by the motor according to a first resistance profile; and determines a readiness of a user to accept a target resistance for performing the exercise based at least in part on the detected speed of the cable; and responsive to determining that the user is ready to accept the target resistance for performing the exercise, switches to controlling the resistance provided by the motor according to a second resistance profile different from the first resistance profile.

2. The exercise machine of claim 1, wherein the first resistance profile comprises an isokinetic profile.

3. The exercise machine of claim 2, wherein the isokinetic profile tension curve comprises a ceiling resistance.

4. The exercise machine of claim 1, wherein the second resistance profile is applied in response to determining that the user is in position to perform the exercise.

5. The exercise machine of claim 4, wherein the determining that the user is in position to perform the exercise is based at least in part on detection of a pattern of cable behavior.

6. The exercise machine of claim 1, wherein the target resistance for performing the exercise is applied in response to completion of a threshold number of repetitions of the exercise.

7. The exercise machine of claim 1, wherein the resistance is applied based at least in part on a determined amount of cable extension.

8. The exercise machine of claim 1, wherein the resistance is applied based at least in part on an amount of cable distance traveled across concentric phases of one or more repetitions of the exercise.

9. The exercise machine of claim 1, wherein the readiness of the user to accept the resistance is determined at least in part by determining that the user is applying force at the target resistance and at least a target isokinetic speed.

10. A method, comprising:

detecting, using a sensor, a state of a cable, wherein a motor is mechanically coupled to the cable to provide resistance during an exercise by tensioning the cable, and wherein the state of the cable comprises a speed of the cable;

during a readiness-detection phase:

controlling the resistance provided by the motor according to a first resistance profile; and determining a readiness of a user to accept a target resistance for performing the exercise; and responsive to determining that the user is ready to accept the target resistance for performing the exercise, switching to controlling the resistance provided by the motor according to a second resistance profile different from the first resistance profile.

11. The method of claim 10, wherein the first resistance profile comprises an isokinetic profile.

12. The method of claim 11, wherein the isokinetic profile comprises a ceiling resistance.

13. The method of claim 10, wherein the second resistance profile is applied in response to determining that the user is in position to perform the exercise.

14. The method of claim 13, wherein the determining that the user is in position to perform the exercise is based at least in part on detection of a pattern of cable behavior.

15. The method of claim 10, wherein the target resistance for performing the exercise is applied in response to completion of a threshold number of repetitions of the exercise.

16. The method of claim 10, wherein the resistance is applied based at least in part on a determined amount of cable extension.

17. The method of claim 10, wherein the resistance is applied based at least in part on an amount of cable distance traveled across concentric phases of one or more repetitions of the exercise.

18. The method of claim 10, wherein the readiness of the user to accept the resistance is determined at least in part by determining that the user is applying force at the target resistance and at least a target isokinetic speed.

* * * * *